US005299872A

United States Patent [19]

Ueno

[11] Patent Number: 5,299,872

[45] Date of Patent: Apr. 5, 1994

[54] PRINTING MACHINE WITH SINGLE LINE TYPE FACE

[75] Inventor: Hideo Ueno, Nagoya, Japan

[73] Assignee: Brother Kogyo Kabushiki Kaisha, Japan

[21] Appl. No.: 997,132

[22] Filed: Dec. 23, 1992

Related U.S. Application Data

[63] Continuation of Ser. No. 612,811, Nov. 14, 1990, abandoned.

[30] Foreign Application Priority Data

Nov. 20, 1989 [JP] Japan ..... 1-301398
Nov. 20, 1989 [JP] Japan ..... 1-301399

[51] Int. Cl.[5] ..... B41J 1/30; B41J 3/01
[52] U.S. Cl. ..... 400/17; 400/144.2
[58] Field of Search ..... 400/17, 65, 144.2

[56] References Cited

U.S. PATENT DOCUMENTS 4,359,286 11/1982 Barnes ..... 400/76
4,580,916 4/1986 Rolfo ..... 400/144.2

FOREIGN PATENT DOCUMENTS 0052725 6/1982 European Pat. Off. ..... 400/144.2
0063939 11/1982 European Pat. Off. ..... 400/144.2
0203411 12/1986 European Pat. Off. ..... 400/144.2
61-15831 5/1982 Japan ..... 400/157.2
2072388 9/1981 United Kingdom ..... 400/144.2
1604577 12/1981 United Kingdom ..... 400/144.2

*Primary Examiner*—David A. Wiecking
*Assistant Examiner*—Steven S. Kelley
*Attorney, Agent, or Firm*—Jones, Tullar & Cooper

[57] ABSTRACT

A printing machine comprising a printing head, a drive unit for printing, a mode setting unit, a data supplying unit, and a controller that controls the print drive unit based on data supplied from the data supplying unit is disclosed. The printing machine may use any one of a plurality of printing heads having different type faces. The printing machine compensates for different line type faces and/or a different type-face layouts between heads. The print drive unit selectively moves one type face on the printing head to a predetermined position above a print paper and prints the character on the paper. The mode setting unit serves to set a mode associated with the printing head in use. The data supplying unit holds data about printing, including line data. When the data from the data supplying unit is line data, the controller selects the type face on the printing head for line printing associated with the line data, based on this line data and the mode set by the mode setting unit, then prints the selected character on the paper at a given position.

7 Claims, 11 Drawing Sheets

| MODE / DATA | I | II | III |
|---|---|---|---|
| — | A | B | C |
| \| | D | E | F |
| = | G | H | I |
| \|\| | J | K | L |

FIG. 7

FIG. 9A

| MODE / DATA | I | II | III |
|---|---|---|---|
| — | A | B | C |
| \| | D | E | F |
| = | G | | H |
| ‖ | J | | K |

FIG. 9B

| DATA | SIMILAR TYPE FACE |
|---|---|
| = | — |
| ‖ | \| |

| | | | | |
|---|---|---|---|---|
| | | | | |
| | | | | |
| | | | | |
| | | | | |

FIG. 10A

| | | | | |
|---|---|---|---|---|
| | | | | |
| | | | | |
| | | | | |
| | | | | |

FIG. 10B

| MODE / DATA | I | II | III |
|---|---|---|---|
| — | A | B | C |
| \| | D | E | F |
| = | G | B | I |
| ‖ | J | E | L |

FIG. 14A (Prior Art)

| | | | | |
|---|---|---|---|---|
| | | | | |
| | | | | |
| | | | | |
| | | | | |

FIG. 14B (Prior Art)

| | | |
|---|---|---|
| $ | $ | |
| $ | $ 1,000 | |
| $ | $ | |
| $ | $ | |

FIG. 14C (Prior Art)

| | | |
|---|---|---|
| | | |
| | | |
| | | |
| | | |

PRINTING MACHINE WITH SINGLE LINE TYPE FACE

This is a continuation of co-pending application Ser. No. 07/612,811 filed on Nov. 14, 1990, now abandoned.

BACKGROUND OF THE INVENTION

1. Field of the Invention

The present invention generally relates to a printing machine which can selectively use two or more types of printing heads having different kinds of and layouts of type faces. More particularly, this invention relates to a printing machine characterized by its printing of ruled lines (or simple lines).

2. Description of the Related Art

Conventionally, printing machines, such as typewriters or printers, have been proposed which can print lines as well as characters in order to prepare a fine table. For instance, a printing machine is known which has a daisy wheel with type faces for line printing and prints lines in accordance with a key operation (see Published Examined Japanese Patent Application No. 61-15831). Normally, printing machines, such as typewriters or word processors, can use any of several kinds of replaceable daisy wheels with different layouts of type faces as desired. There are a plurality of daisy wheels having different layouts of type faces associated with countries to which printers are to be exported. The daisy wheels include an English wheel for the U.S.A. or other English speaking countries, an international wheel with the type face layout common to all the countries, which permits printing of German, Spanish, etc. in addition to English, and a symbol wheel having only symbol type faces.

In general, due to differences in the kinds of type faces that should be provided, key operations and customs, the layout of non-alphanumeric characters are varied dependant on the particular daisy wheel used. Therefore, data prepared specifically for a certain daisy wheel, if saved in an internal memory of the printing machine or a floppy disk, cannot be used at all when a different daisy wheel is in use. This requires that different data be prepared in advance for different daisy wheels.

In preparing English text and German text, these texts should naturally be prepared separately. However, table layout data should be useable irrespective of whether the language in use is English or German. This is because it is often desirable to use the same table regardless of the language in use. Line data, unlike words, however, should be input while counting the number of characters between lines in light of the size of the table. Entering the line data is very troublesome compared with text input. According to the conventional printing machines, as described above, line data should be prepared separately for individual daisy wheels, requiring more work to prepare a table and thus making the work tiresome.

Type faces equipped on a daisy wheel for lines include horizontal and vertical single lines, such as "—" and "|" and horizontal and vertical double lines, such as "=" and "||". As the kinds of type faces on the individual daisy wheels and the layouts of the type faces differ due to the difference in customs in the countries where the daisy wheels are used, it often happens that one daisy wheel has a type face for a vertical double line while the others do not.

With no type face for a vertical double line on a daisy wheel, there would arise the following problem in preparing a table as shown in FIG. 14A (the table horizontally divided into three sections by vertical double lines with the center and right sections each further bisected by a vertical single line). A non-line character, such as "$," would be printed where the vertical double lines should be printed. In this case, as "$" is printed where the double lines should be, even when one wishes to simply print a numeral "1,000," "$1,000," an amount of money, would be printed against the operator's intention.

One proposed solution to the above shortcoming suggests inhibiting printing a double vertical line if the daisy wheel in use does not have an appropriate type face. However a table printed in this manner (FIG. 14C) would be quite different from the intended one (FIG. 14A).

SUMMARY OF THE INVENTION

Accordingly, it is a primary object of the present invention to provide a printing machine which allows line data prepared for a specific printing head to be printed even if a different printing head is used to print lines based on the line data.

Another object is to provide a printing machine which can print a distinguishable table even when the printing head mounted thereon does not have the line type faces desired by the operator.

To achieve the foregoing and other objects and in accordance with the purpose of the present invention, an improved printing machine is provided, which includes a printing head, a drive unit for printing, a mode setting unit, a data supplying unit, and a controller that controls the print drive unit based on data supplied from the data supplying unit.

The printing head has a plurality of type faces including various line type faces. The print head is replaceable by other printing heads having different type faces and/or a different type-face layout. The print drive unit selectively moves one type face on the printing head to a predetermined position above a print paper and prints the character on the paper. The mode setting unit serves to set the mode for the printing head (or type face) presently in use. The data supplying unit holds data about printing, including line data. When the data from the data supplying unit is line data, the controller selects the type face on the printing head for line printing associated with the line data, based on this line data and the mode set by the mode setting unit, then prints the selected character on the paper at a given position.

BRIEF DESCRIPTION OF THE DRAWINGS

The features of the present invention that are believed to be novel are set forth with particularity in the appended claims. The invention, together with the objects and advantages thereof, may best be understood by reference to the following description of presently preferred embodiments together with the accompanying drawings of which:

FIG. 7 is an exemplary diagram of a conversion table used in the line printing in the first embodiment;

FIG. 9A is an exemplary diagram of a conversion table used in the line printing in the second embodiment;

FIG. 9B is an exemplary diagram of a similar-type-face conversion table used in the line printing in the second embodiment;

FIG. 10A is a diagram exemplifying what is printed in the second embodiment;

FIG. 10B is a diagram depicting what is printed in a third embodiment;

FIGS. 14A through 14C illustrate what is printed by the prior art for explanation of the shortcoming of the prior art.

DETAILED DESCRIPTION OF THE PREFERRED EMBODIMENTS

The first through third preferred embodiments of the present invention as embodied in a word processor will now be described referring to the accompanying drawings.

First Embodiment

Figure 1:
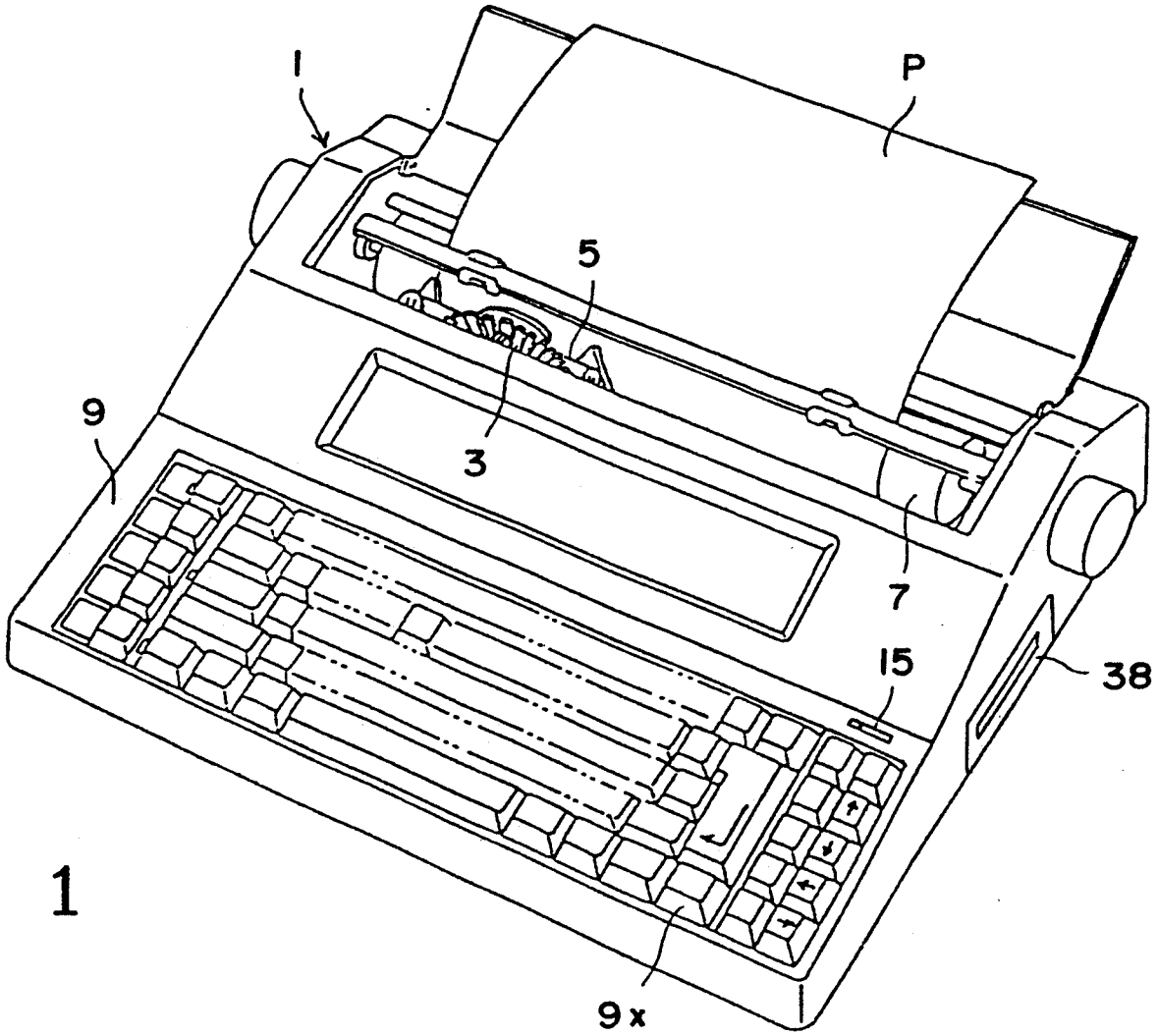
FIG. 1 is a perspective view of a word processor embodying the present invention.
Figure 2:
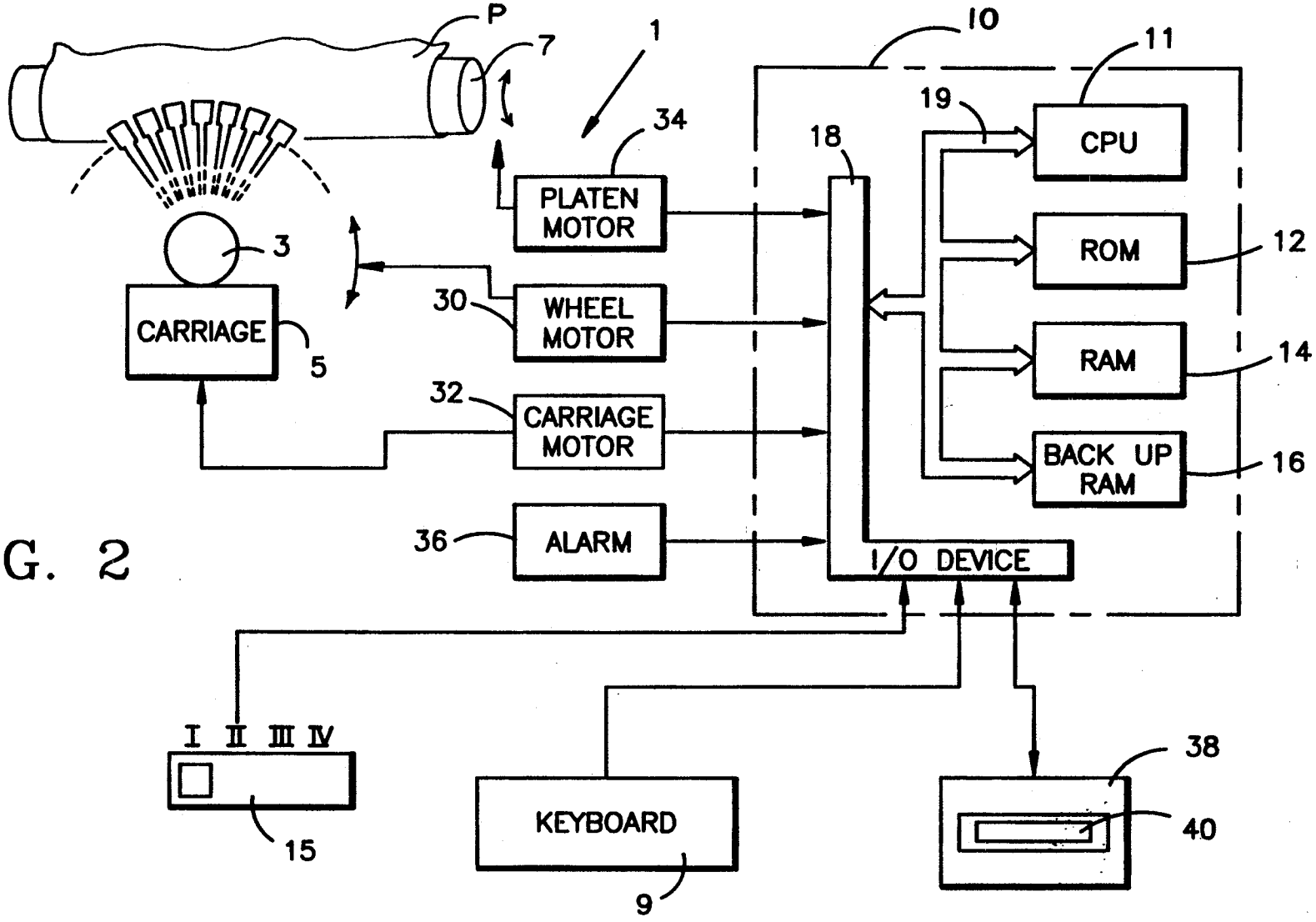
FIG. 2 is a block diagram showing the structure of the word processor.

As shown in FIGS. 1 and 2, a word processor 1 comprises a carriage 5 to which a daisy wheel 3 is detachably mounted, and a platen 7 which rotates in the forward and reverse directions, holding print paper P. The word processor 1 further includes a keyboard 9 through which an operator can enter data and instruct the content of a process to be done, and a controller 10 for controlling the data input, edition, printing, etc.

Figures 3, 4:
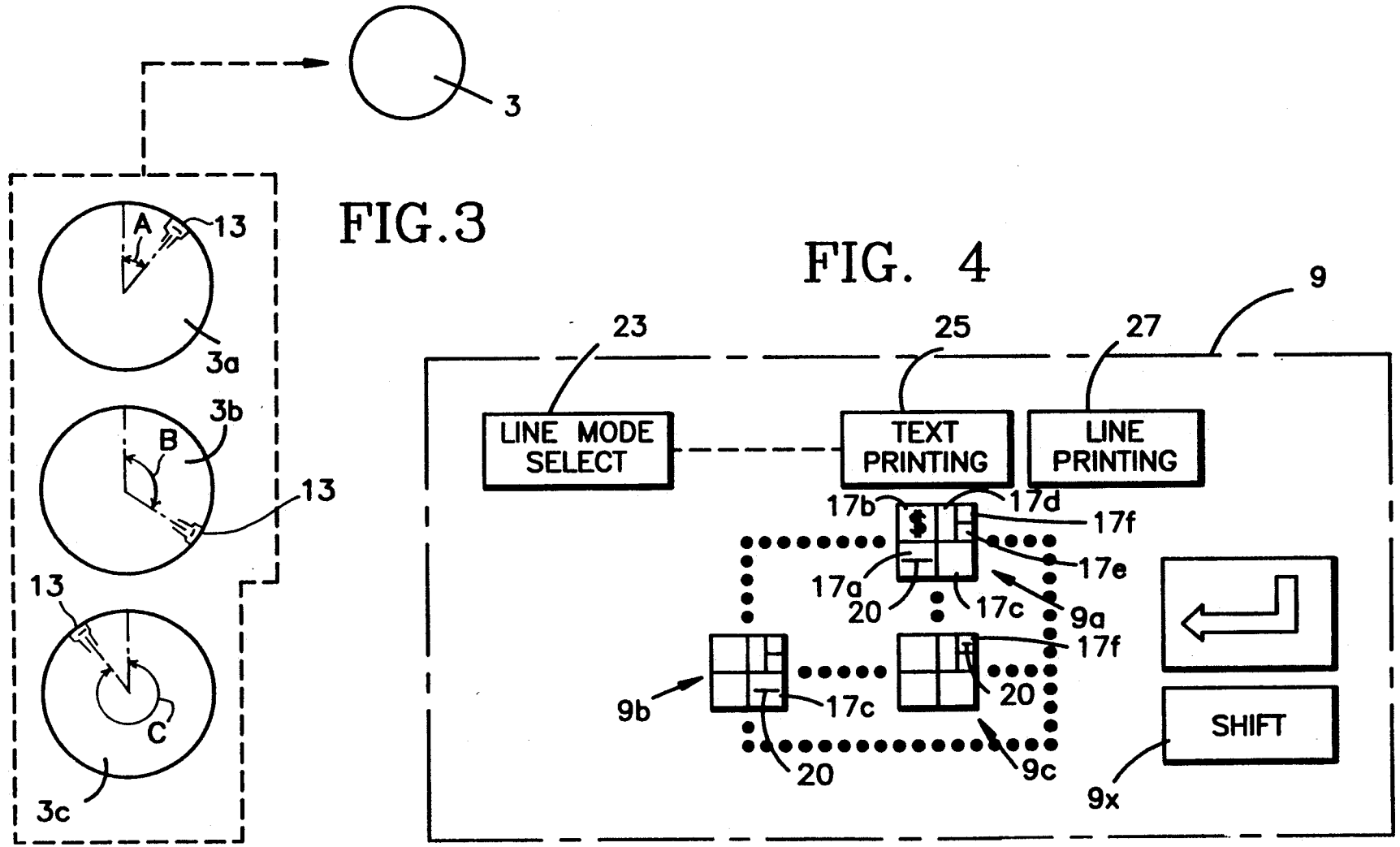
FIG. 3 is a plan view of a plurality of replaceable daisy wheels.
FIG. 4 is a plan view of a keyboard.

As shown in FIG. 3, there are three daisy wheels 3 provided: a country wheel 3*a* having type faces designed for a specific country where the word processor 1 is to be expected or used, an international wheel 3*b* having type faces common to all the countries, and a symbol wheel 3*c* having symbolic type faces. The operator selects one of these daisy wheels when using it.

The individual wheels 3*a* to 3*c* have the same type face for a line (e.g., horizontal single line "—"). In this case, the same line type faces 13 of the wheels 3*a* to 3*c* have different select angles (rotational angle from the origin set to select the type face) A, B and C.

The word processor 1 also includes a mode switch 15 that serves to set a mode associated with each wheel to thereby select the kind of the wheel presently mounted. With the country wheel 3*a* mounted, the operator sets the mode switch 15 to mode I. Likewise, the mode switch 15 is set to mode II when the international wheel 3*b* is mounted, and to mode III when the symbol wheel 3*c* is mounted. According to this word processor 1, a user-optional daisy wheel is also replaceable. When this user-optional daisy wheel is mounted, the mode switch 15 is set to IV. Set data from the mode switch 15 is sent to the controller 10.

As illustrated in FIG. 4, alphanumeric keys 9*a*, 9*b*, 9*c*, . . . on the keyboard 9 each have the key top horizontally and vertically quartered into first to fourth areas 17*a*–17*d*, and have the right half of the fourth area 17*d*, the upper right area, further vertically separated into fifth and sixth areas 17*e* and 17*f*. On the top of the individual areas 17*a* to 17*f* are shown characters which are to be input as print data when the associated key 9*a*, 9*b*, 9*c*, . . . is depressed at the time of setting a mode. In other words, characters which are associated with the country wheel 3*a* and to be input when mode I is set are shown on the top of the first and second areas 17*a* and 17*b*. The character "$" on the second area 17*b* is what is input when the key 9*a* is depressed while pressing a shift key 9*x*. Likewise, characters in association with the international wheel 3*b*, which are to be input when mode II is set, are shown on the top of the third and fourth areas 17*c* and 17*d*. Further, characters in association with the symbol wheel 3*c*, which are to be input when mode III is set, are shown on the top of the fifth and sixth areas 17*e* and 17*f*.

For instance, in entering a character 20 ("—") corresponding to the type face 13 for the horizontal single line, the operator needs to simply depress the key 9*a* (first area 17*a*) when the country wheel 3*a* is mounted (mode I). Likewise, the operator has only to depress the key 9*b* (third area 17*c*) when the international wheel 3*b* is mounted (mode II), and to depress the key 9*c* together with the shift key 9*x* (sixth area 17*f*) when the symbol wheel 3*c* is mounted (mode III).

The keyboard 9 further has various function keys 23, 25 and 27. The first function key 23 is a line mode select key to change the input mode to a text edition mode from a line edition mode. The second function key 25 is a text printing key to instruct the execution of text printing. The third function key 27 is a line printing key to instruct the execution of line printing.

As shown in FIG. 2, the controller 10 includes a CPU (Central Processing Unit) 11, ROM (Read Only Memory) 12, RAM (Random Access Memory) 14 and backup RAM 16. The CPU 11 exchanges data and commands with the ROM 12, etc. via a bus 19, and with an external device via an I/O device 18.

The I/O device 18 is connected with three stepping motors, namely wheel motor 30, carriage motor 32 and platen motor 34. The wheel motor 30 rotates the daisy wheel 3 to select a type face on the wheel. The carriage motor 32 moves the carriage 5 along the platen 7 reciprocally in the horizontal direction. The platen motor 34 rotates the platen 7 forwardly or reversely. The controller 10 exchanges data and drive command signals with these motors 30, 32 and 34.

The I/O device 18 is connected with the mode switch 15 and keyboard 9, so that a set signal from the switch 15 and an input signal from the keyboard 9 are input to the controller 10. The I/O device 18 is also connected to an alarm 36 which generates an alarm when the controller 10 cannot execute data processing. The I/O device 18 is further connected to a floppy disk driver 38 through which the controller 10 can read out data from a floppy disk 40 or write data thereon.

The following describes the general control procedures of the word processor 1 and the control procedures for line printing. First of all, the general control procedures of the word processor 1 will be described below referring to FIG. 5.

When the word processor 1 is activated, the controller 10 first performs initialization (step 1: hereinafter simply referred to as S1 and the same will also be applied to the other steps). As a result, the motors 30, 32 and 34 are activated, setting the daisy wheel 3, the carriage 5 and the platen 7 to the initial positions. Then, the controller 10 scans the keyboard 9 for an input, and moves to the next step only when a key input has been made (S2). Based on the type of the key operated, the controller 10 determines whether or not the input/edit process should be executed (S3). More specifically, when the key 9a, 9b, 9c or the like has been operated, the controller 10 judges that the input/edit process should be performed.

When the key input is associated with the input/edit process, the controller 10 discriminates whether the text edition mode is set or the line edition mode is set (S4) and executes the proper process based on the decision (S5, S6). Then, the controller 10 returns to S2 to be ready for the next key input while scanning the keys.

The decision about the text edition mode is made on the basis of the value of a text edition mode flag provided in the RAM 14. The mode is the text edition mode when this flag has a value "1," and is the line edition mode when the flag value is "0." The mode flag is set to a value "1" when the word processor 1 is activated, and is set to "0" in S8 (which will be described later) when the line mode select key 23 is depressed. The mode will return to the text edition mode when this key 23 is depressed again to set the mode flag to "1."

When the key 9a is depressed with the mode flag holding a value "1," the input will be treated as entering the underline in text (S4, S5). When the key 9a is depressed with the mode flag holding a value "0," the input will be treated as entering the horizontal line in text (S4, S6).

When the key input is not associated with the text edition mode in S3 (i.e., the key operation involves the functions keys 23, 25, 27, etc.), then the controller 10 discriminates whether or not the key input is a print instruction (S7). If it instructs a process other than the printing, e.g., data writing on the floppy disk 40 or alteration of the setting of the input/edition mode, the controller 10 executes the specified process (S8), then returns to S2.

If depression of the text printing key 25 or line printing key 27 is detected in S7, the controller 10 determines which key is depressed (S9) and executes the text printing (S10) or line printing (S11) based on the decision. After the printing, the controller 10 returns to S2.

Figure 5:
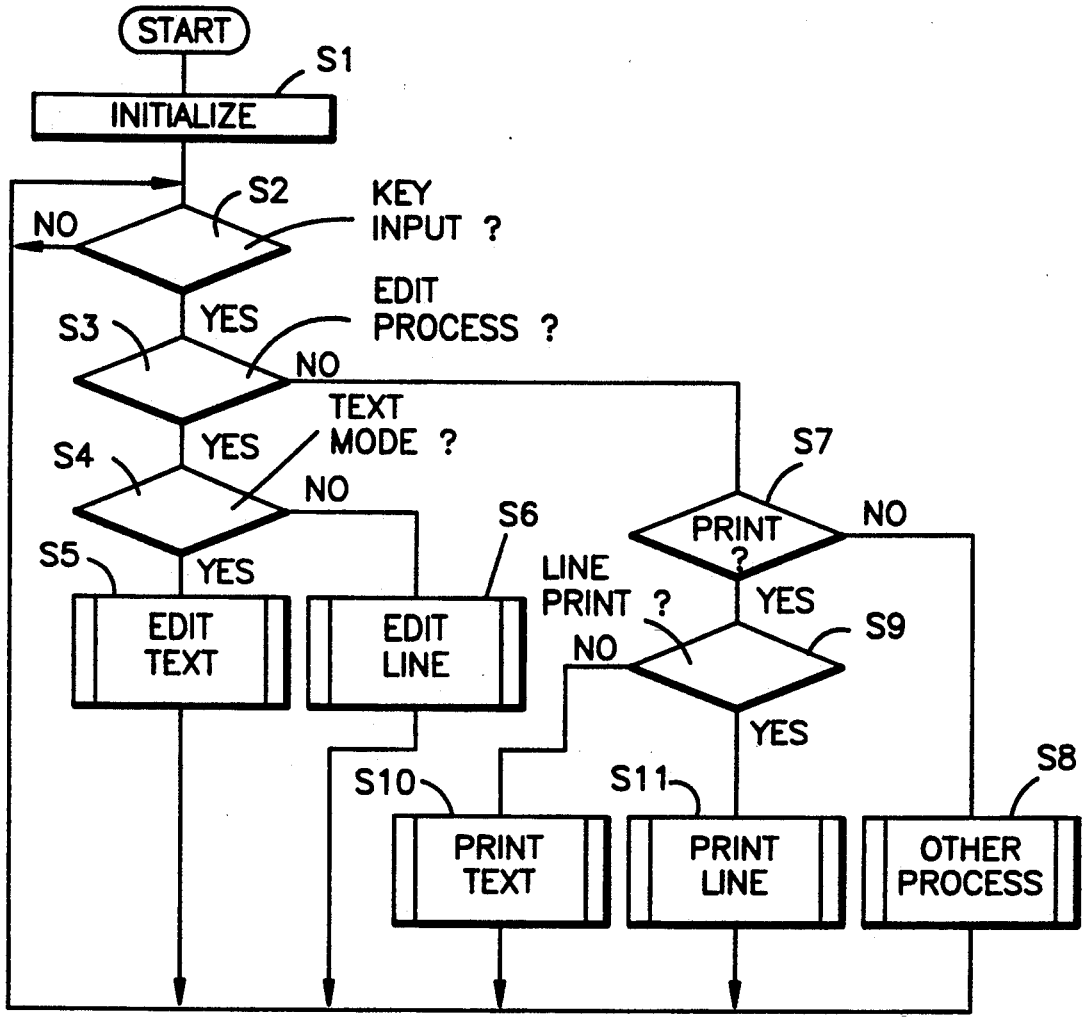
FIG. 5 is a flow chart illustrating the general control procedures for the word processor.
Figure 6:
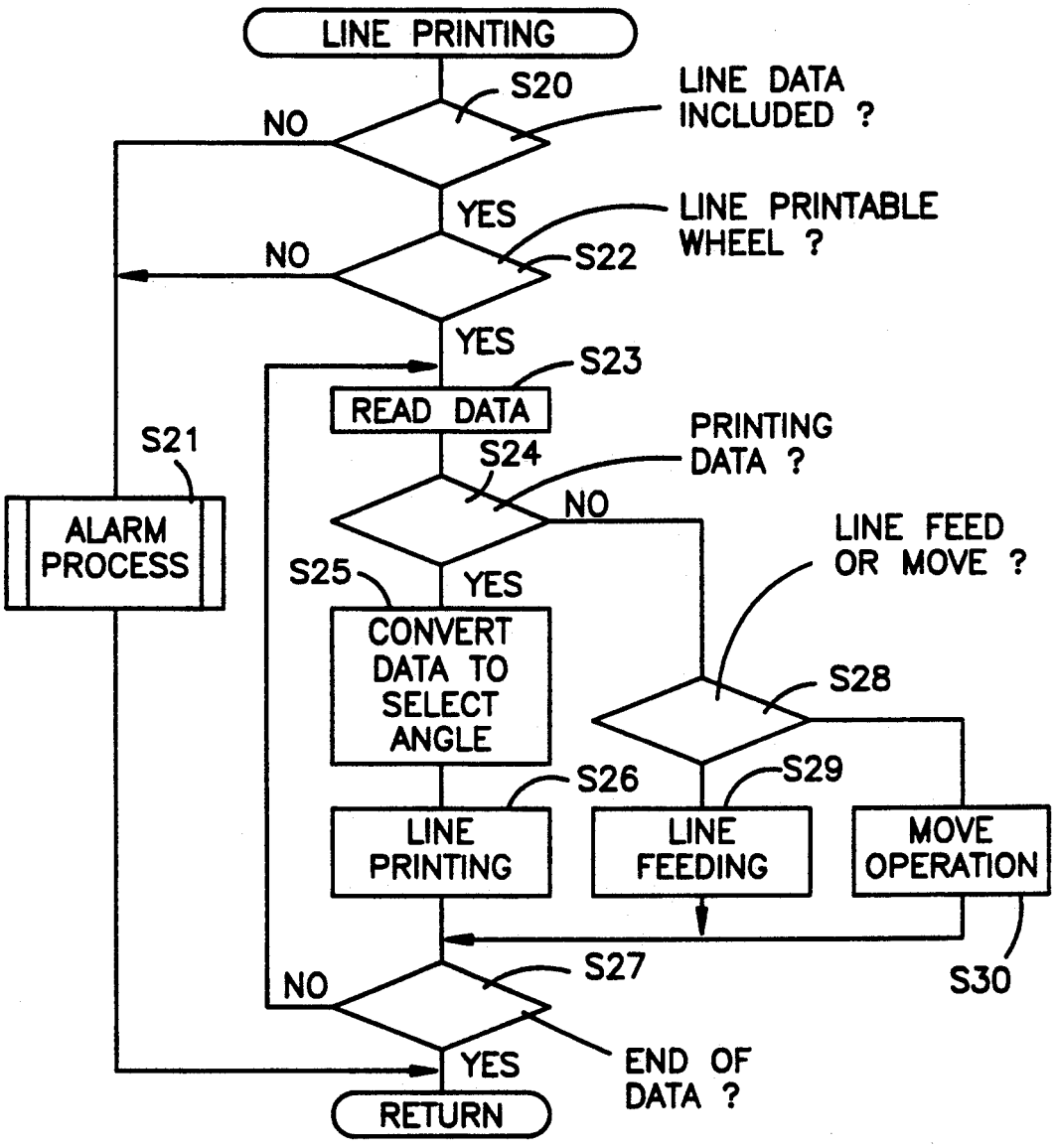
FIG. 6 is a flow chart illustrating line-printing procedures according to a first embodiment.

The control of the line printing in S11 will be described below according to the line printing routine illustrated in FIG. 6. In this routine, first the CPU 11 determines whether or not line data is included in printing data stored in the RAM 14 (S20). If the printing data includes no line data, the CPU 11 causes the alarm 36 to generates an alarm (S21), informing the operator of the wrong key operation, then returns to the main routine (FIG. 5).

If the line data is present in S20, the CPU 11 judges whether or not the daisy wheel 3 presently mounted has a type face corresponding to this line data (S22). The presence/absence of this type face is determined on the basis of the mode set by the switch 15. If the mode IV has been set, which means that the user-optional wheel is mounted, the CPU 11 judges that the requested type face is not present and generates an alarm from the alarm 36 (S21). With the mode set to other than the mode IV, the CPU 11 reads out a single piece of line data from the RAM 14 (S23).

In the subsequent step (S24), the CPU 11 discriminates whether the data is printing data or other data (e.g., control data). In the case of the printing data, this data is converted to a select angle corresponding to the line type face on the wheel 3 (S25). This conversion is done on the basis of a conversion table (FIG. 7) stored in advance in the ROM 12. According to this table, the select angles A to L of the wheel 3 are determined by specifying the type of the line data (i.e., vertical/horizontal single line, vertical/horizontal double line) and the mode (I, II, III). This angle is between the origin of the wheel 3 at the initial position and the position of the type face 13 corresponding to the line data (see FIG. 3). For instance, the select angle is A degrees when the line data is the horizontal single line and the mode I is set, and is C degrees when the mode is changed to the mode III.

The CPU 11 determines the number of drive steps of the wheel motor 30 based on the select angle. The CPU 11 rotates the motor 30 by this step number through the I/O device 18 to select the desired or target type face and prints the character of the type face on the paper P held on the platen 7 (S26). After a single piece of line data is printed, the CPU 11 determines whether or not there exists further data (S27), and returns to S23 if there still is data.

If read-out data is other than printing data in S24, i.e., if it is control data concerning the line feed or carriage movement, the CPU 11 drives the carriage motor 32 and/or platen motor 34 to execute the line feeding (S29) or carriage movement (S30) after going through the decision step S28. Thereafter, the CPU 11 checks for the end of data in S27 as described above. If there still exists data, the flow returns to S23, and if no further data is present, this routine is terminated.

According to this embodiment, regardless of which mode the line data has been input to, the line printing exactly reflecting the line data can surely be executed using the daisy wheel 3 presently mounted. Therefore, a table once prepared and if saved on the floppy disk 40 can be used for any daisy wheel.

Second Embodiment

This embodiment has the same hardware structure (FIGS. 1–4) and the same general operation procedures (FIG. 5) as the first embodiment, but differs in the line printing routine which will be described below. Assume that, in the second embodiment, the country wheel 3a and symbol wheel 3c have the vertical and horizontal single lines ("|", "—") and the vertical and horizontal single lines ("||", "="), while the international wheel 3b has only the former single lines.

Figure 8:
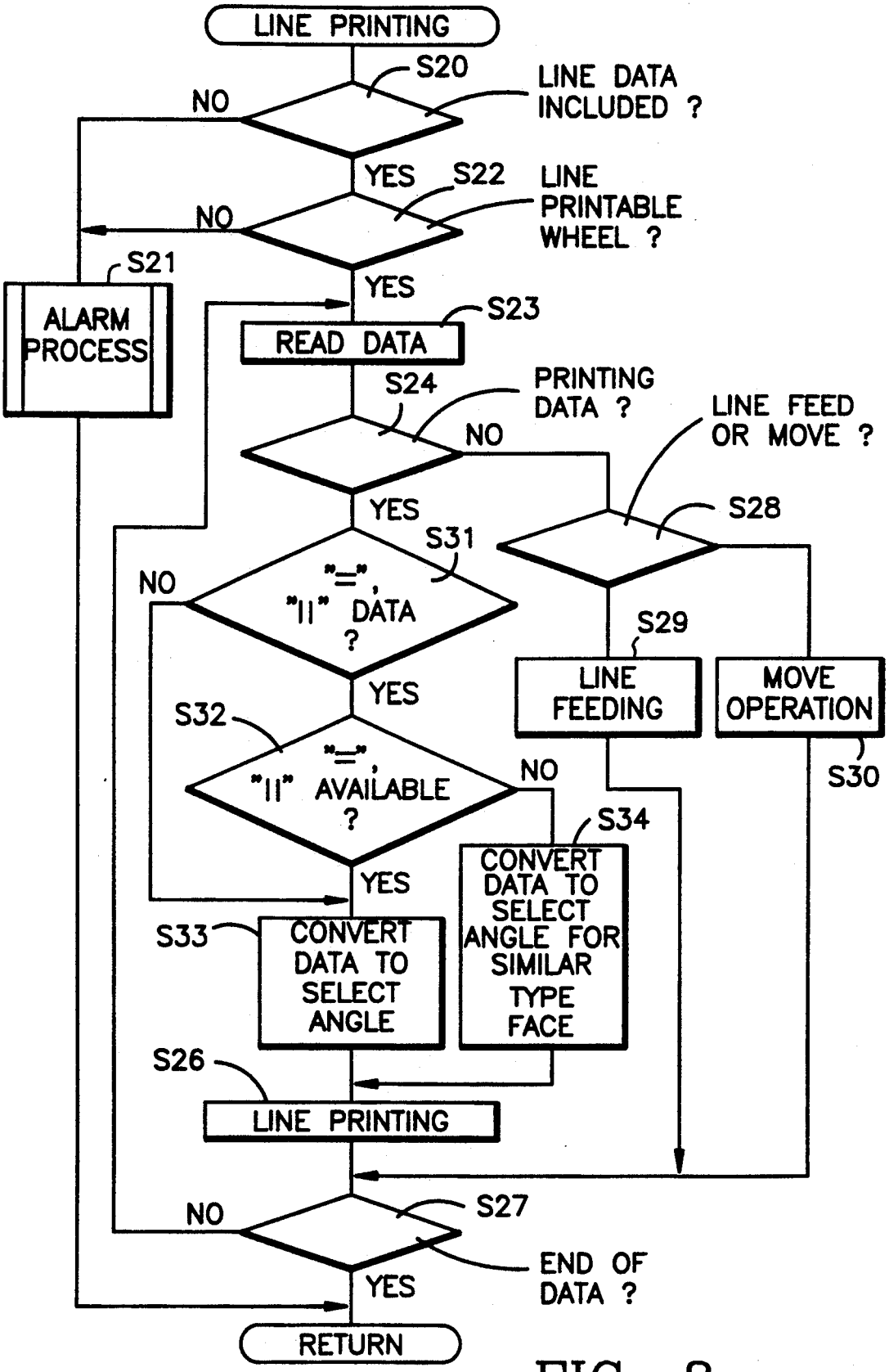
FIG. 8 is a flow chart illustrating line-printing procedures according to a second embodiment.

FIG. 8 illustrates the contents of the line printing routine of the second embodiment, executed in S11 in FIG. 5. Since the flow up to S24 in FIG. 8 is the same as that of the first embodiment (see FIG. 6), the description of this part will be omitted. The CPU 11 determines whether the read-out data is printing data or control data (S24). If it is printing data, the CPU 11 discriminates whether or not the data is associated with the vertical or horizontal double line (S31). If it is not the double-line data, the CPU 11 converts the data into a select angle for the currently- mounted daisy wheel (S33). This conversion is done referring to the conversion table (see FIG. 9A) stored in the ROM 12. The conversion table is designed to be able to specify the select angle A–L based on the type of line data and the set mode (I, II, III).

If the data is associated with the vertical or horizontal double line in S31, the CPU 11 determines whether or not the daisy wheel 3 presently mounted has a type face of the corresponding line (S32). If the wheel has the corresponding type face, the CPU 11 acquires the select angle for the type face based on the conversion table shown in FIG. 9A, as described above.

If it is found in S32 that the daisy wheel 3 has no type face corresponding to the vertical or horizontal double line, the CPU 11 goes to S34. The decision in S32 is made on the basis of the conversion table shown in FIG. 9A. For example, if the mode II is set, there is no information of the select angle corresponding to the data of the vertical and horizontal double lines on the conversion table. In this case, therefore, the CPU 11 can know that the corresponding type face is not available.

In S34, the CPU 11 converts the data of the vertical or horizontal double line into data of the vertical or horizontal single line based on a similar type face table (FIG. 5B) stored in the ROM 12. Then, the CPU 11 refers to the conversion table (FIG. 9A) again to convert the data of the vertical or horizontal single line into a select angle. For instance, if the data of the horizontal double line has been read in mode II, "B" which is the select angle of the type face of the horizontal single line would be acquired finally.

Based on the thus acquired select angle, the CPU 11 drives the wheel motor 30, etc. to execute line printing (S26). After printing a single piece of line data is completed, the CPU 11 determines whether or not further data exists (S27), and returns to S23 if there still is data. If it is the end of data in S27, the CPU 11 terminates this routine.

If the mode II is set which involves a daisy wheel having no type faces for the double lines, the type face for the vertical or horizontal single line can be used instead for the line printing. As shown in FIG. 10A, therefore, a table similar to the intended table (e.g., the one shown in FIG. 14A) can be printed.

Third Embodiment

This embodiment has the same hardware structure (FIGS. 1–4) and the same general operation procedures (FIG. 5) as the first and second embodiments, but differs in the line printing routine which will be described below. Assume that, in the third embodiment as in the second embodiment, the country wheel 3*a* and symbol wheel 3*c* have the vertical and horizontal single lines ("|", "—") and the vertical and horizontal double lines ("||", "="), while the international wheel 3*b* has only the former single lines.

Figure 11:
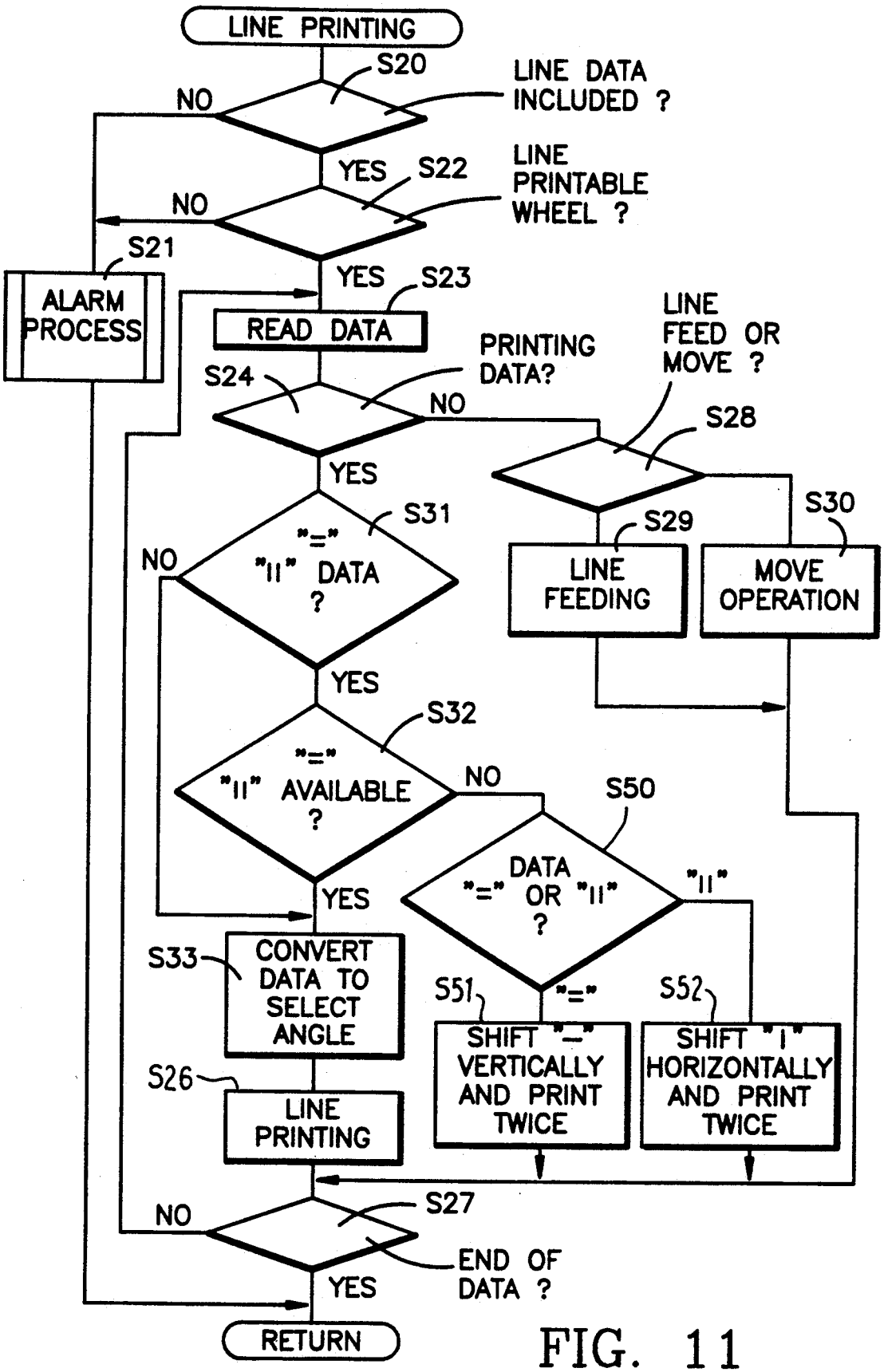
FIG. 11 is a flow chart illustrating line-printing procedures according to the third embodiment.

FIG. 11 illustrates the contents of the line printing routine of the third embodiment, executed in S11 in FIG. 5. Since the flow up to S31 in FIG. 11 is the same as that of the second embodiment (see FIG. 8), the description of this part will be omitted.

The CPU 11 determines in S32 whether or not the daisy wheel 3 presently mounted has any type face for the double line associated with the line data. If the daisy wheel 3 has the corresponding type face, the CPU 11 acquires the select angle for this type face based on the conversion table shown in FIG. 9A, as in the previous case. Upon judging in S32 that the daisy wheel 3 has no type face corresponding to the vertical or horizontal double line, the CPU 11 determines whether the read data is associated with the horizontal double line or the vertical double line (S50).

If it is the horizontal double line, the CPU 11 selects the type face of the horizontal single line as an alternative type face from the similar type face table (FIG. 9B) and obtains the select angle B from the conversion table (FIG. 9A), as done in S34 of the second embodiment. Then, the CPU 11 drives the wheel motor 30 to select the type face of the horizontal single line as an alternative. In printing the character of this type face, the CPU 11 feeds the paper P by driving the platen motor 34 without horizontally moving the carriage 5, so that the horizontal line would be printed on two positions slightly shifted in the vertical direction (S51). As a result, the horizontal double line is printed on the paper P.

In this case, the CPU 11 executes the first printing using the type face of the horizontal single line after driving the platen motor 34 in the reverse-feeding direction by an amount corresponding to half of the pitch between the two lines of the horizontal double line. Then, the CPU 11 executes the second printing using the same type face after driving the platen motor 34 in the forward-feeding direction by an amount corresponding to the full pitch between the two lines of the horizontal double line. The CPU 11 then drives the platen motor 34 in the reverse-feeding direction by an amount corresponding to half the pitch between the two horizontal lines. In this way, it is possible to print on the paper P the horizontal double line having the same center axis as the horizontal double line which is printed using the proper type face of the horizontal double line. According to the above-described control of the platen motor 34, after the printing is done, the type face of the horizontal single line is returned to where it was before the printing, thus preventing the position of the next type face from being shifted or deviated in the feeding direction from the proper position.

In the case of the data of the vertical double line, the CPU 11 likewise acquires the select angle E for the type face for the vertical single line, an alternative of the vertical double line. The CPU 11 then drives the wheel motor 30 to select the type face of the vertical single line as an alternative. In printing the character of this type face, the CPU 11 drives the carriage motor 32 to horizontally move the carriage 5 without feeding the paper vertically, so that the vertical line would be printed on two positions slightly shifted in the horizontal direction (S52). As a result, the vertical double line is printed on the paper P.

In this case, the CPU 11 executes the first printing using the type face of the vertical single line after driving the carriage motor 32 in the reverse direction by an amount corresponding to a half of the pitch between the two lines of the vertical double line. Then, the CPU 11 executes the second printing using the same type face after driving the carriage motor 32 in the forward direction by an amount corresponding to the full pitch between the two vertical lines. The CPU 11 then drives the carriage motor 32 in the reverse direction by an amount corresponding to half the pitch between the two vertical lines. In this way, it is possible to print on the paper P the vertical double line having the same center axis as the vertical double line which is printed using the proper type face of the vertical double line. According to the above-described control of the carriage motor 32, the character pitch does not vary at the printing time.

The CPU 11 advances to S27 after executing the process of S51 or 52. The CPU 11 repeats the sequence of processes from S23 to S27 until no further data exists.

According to this embodiment, as described above, even though the international wheel 3*b* has no type faces for the vertical and horizontal double lines, it is possible to prepare a table reflecting the line data as shown in FIG. 10B.

As described above, according to the second and third embodiments, even if a daisy wheel having no type face for the line data is mounted, an alternative type face can be used to print the desired line. The operator can therefore prepare a table which presents no problem in writing at least numerals and characters.

In a case where table data involving the vertical and horizontal double line has been prepared in advance and German alphabets need to be printed after printing the table, both the line printing and text printing can be done using only the international wheel 3*b*. This eliminates the need to change the daisy wheel 3 to the international wheel 3*b* for text printing after executing the line printing using the symbol wheel 3*c* as done in the prior art, thus significantly improving operability.

Particularly, according to the third embodiment, a table quite the same as the intended table can be prepared not only by the use of an alternative type face but also executing the process of S51 or S52.

According to the first to third embodiments, the conversion table is referred to in converting line data into the select angle of the associated type face or judging if the associated type face is available. Even if the kind and the layout of the type faces of the country wheel 3*a* for the U.S.A. differ from those for West Germany, for example, simply changing the conversion table can provide word processors for different countries. In other words, the present invention can considerably simplify the designing of word processors for the usage and countries to which they are to be exported or alteration of the design.

Further, as the second and third embodiments allow printing using an alternative type face, it is possible to effectively use data prepared for another daisy wheel. In particular, according to the third embodiment, the same table as intended can be finely prepared using the original data as it is. If the mode in which the table data has been prepared differs from the mode in which printing should be done, a table closely or exactly reflecting the intention of the one who has prepared the table data can be printed on the basis of that data.

Data for table printing prepared for a certain daisy wheel can be used for other types of daisy wheels according to the present invention, thus significantly improving the work to prepare a table, while such table printing data should normally be prepared for each daisy wheel according to the prior art. In other words, table data once prepared and if saved on the floppy disk 40 can be used many times for any of the daisy wheels 3*a*–3*c*, thus considerably enhancing the value of the data in use.

Figures 12, 13:
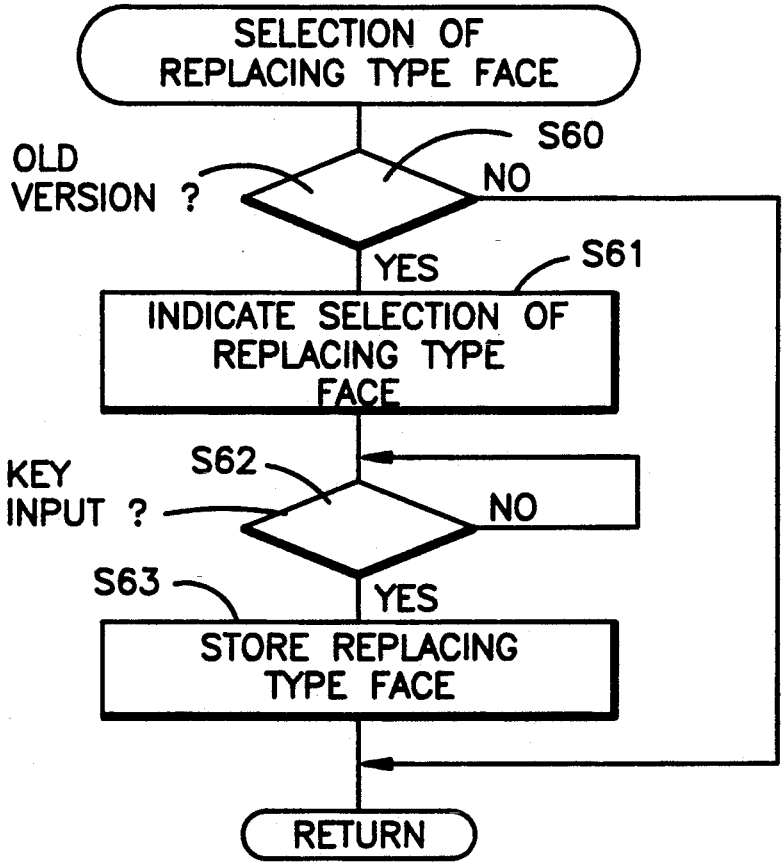
FIG. 12 is a diagram showing another example of the conversion table used in the line printing.
FIG. 13 is a flow chart illustrating another example of how to select similar type faces.

Although only three embodiments of the present invention have been described above, it should be apparent to those skilled in the art that the present invention may be modified in many other forms without departing from the spirit or scope of the invention. Particularly, it should be understood that, although two tables, the conversion table and similar type face table, are used in the second and third embodiments, select angles for alternative type faces may be set in advance in the blanks of the conversion table (FIG. 9A), as shown in FIG. 12. In this case, the decision about the availability of type faces need not be executed as an independent process.

According to the first through third embodiments, in converting printing data into a select angle, this angle is computed based on the conversion table provided for each mode. It may be possible to use line data itself as information of the select angle and provide this data with mode information, so that the select angle associated with the presently-set mode can be calculated on the basis of these data. For instance, if line data prepared in mode I (select angle A) is read in mode II, an angle &A (=B−A) may be added to the angle A to acquire the select angle B for the presently mounted daisy wheel.

Although the line printing key 27 and text printing key 25 are provided separately in the first to third embodiments, a modification may be made so that the CPU 11 judges that it is the line data when the printing key is depressed in line edition mode, and judges that it is the text printing when the printing key is depressed in text edition mode.

The present invention may be applied to a case where a daisy wheel has type faces for double lines but no type faces for single lines.

The amounts of the stepping motor driven from the initial position may be given directly in the conversion table, instead of the values of the angles.

The present invention may also be applied to a word processor which permits lines to be entered by the operation of cursor keys in line edition mode.

The modes I to IV of the daisy wheel are detected on the basis of the setting of the mode switch 15 in the above-described embodiments. Instead, a bar code representing the type of the daisy wheel may be affixed to, for example, a cartridge portion of the wheel and a sensor to read the bar code may be provided on the word processor, so that the type of the wheel can easily be judged by reading the bar code. This eliminates the need to operate the switch 15, making it possible to avoid a wrong judgment of the type of the wheel in use.

Although similar type faces serving as alternative type faces are set in advance in the second and third embodiments, a modification may be made to permit the operator to select the proper alternative type face in each instance requiring such action. FIG. 13 presents a flow chart of the routine for selecting an alternative type face in this case. This is the case where the word processor in use is of a new version in which the vertical and horizontal double lines are no longer available.

The CPU 11 determines whether the printing data has been prepared in the old version (S60). If it has been prepared in the old version, the CPU 11 informs the operator of the selection of an alternative type face (S61). When the operator enters the alternative type face through the keyboard 9 (S62), the CPU 11 stores it in the RAM 14 as an alternative of a double line, for example (S63). When data of the vertical or horizontal double line is fetched, the CPU 11 converts the data to data of the specified alternative.

According to this method, even when a type face to be used differs from the intended one due to the version-up, the old data can be still utilized to prepare a table. Further, the operator can himself or herself select a type face similar to the desired one according to the preference of the operator. This method is not restricted to the version-up case, but may be applied to replace the similar type face table in the second or third embodiment.

The present invention is not limited to a word processor using a daisy wheel, but may be applied to a word processor having a ball type printing head. Therefore, the present examples and embodiments are to be considered as illustrative and not restrictive, and the invention should not be limited to the details given herein, but may be modified in various manners within the scope of the appended claims.

What is claimed is:

1. A printing machine for printing characters and lines on paper using any one of a plurality of replaceable printing heads, each printing head having a plurality of type faces including at least one line type face, the printing machine comprising:

a print drive means for replaceably holding a selected printing head and selectively positioning one of the type faces of the selected printing head relative to a sheet of paper at a predetermined position and printing a character of that type face on the paper;

a mode setting means for setting a mode corresponding to the selected printing head;

a data supplying means having printing data including line data, stored therein;

a data converting means for receiving the line data from the data supplying means and determining whether the selected printing head has a type face corresponding to the line data, based on the line data and the mode setting, and converting the line data to alternative line data, when the selected printing head does not have a type face corresponding to the line data, the alternative line corresponds to type faces that the selected printing head does have; and a control means for controlling the print drive means based on the alternative line data and the mode setting when the printing head does not have a type face corresponding to the original line data, wherein:

the selected printing head has single vertical and horizontal line type faces but does not have double vertical and horizontal line type faces; and when the data converting means converts line data representing vertical double lines to alternative single vertical line data and line data representing horizontal double lines to alternative horizontal single line data.

2. A printing machine according to claim 1, wherein the printing heads are daisy wheels each having a plurality of type faces arranged about a peripheral portion thereof.

3. A printing machine according to claim 2, wherein the print drive means has a wheel motor for rotating the daisy wheel; and the control means refers to a table for specifying a rotational angle of the daisy wheel to calculate an amount of rotation of the daisy wheel, based on the line data from the data supplying means and the mode set by the mode setting means, and drives the wheel motor by the acquired amount of rotation, thereby selecting a line type face corresponding to the line data.

4. A printing machine according to claim 3, wherein the print drive means includes:

a rotatable platen for holding paper at a printing time;

a platen motor for rotating the platen to feed to paper;

a carriage supporting the daisy wheel and the wheel motor and movable along the platen in reciprocative motion; and a carriage motor for reciprocating the carriage.

5. A printing machine according to claim 4, wherein the control means controls the platen motor and the carriage motor based on the data from the data supplying means to thereby position one of the type faces of the printing head in use on paper at a predetermined position.

6. A printing machine according to claim 1, wherein:

the selected printing head has single vertical and horizontal line type faces but does not have double vertical and horizontal line type faces; and when the data converting means converts line data representing vertical double lines to alternative single vertical line data and line data representing horizontal double lines to alternative horizontal single line data.

7. A printing machine according to claim 1, further comprising an alternative type face selecting means for selecting that line data to which line data whose type face is not available on the printing head in use is converted.

* * * * *